US005329847A

United States Patent [19]

Schiel

[11] Patent Number: 5,329,847

[45] Date of Patent: Jul. 19, 1994

[54] PRESS ROLL HAVING COMPONENTS EXHIBITING APPROXIMATELY EQUAL GRAVITY INDUCED FLEXURE

[75] Inventor: Christian Schiel, Heidenheim, Fed. Rep. of Germany

[73] Assignee: J.M. Voith GmbH, Heidenheim, Fed. Rep. of Germany

[21] Appl. No.: 17,759

[22] Filed: Feb. 16, 1993

[30] Foreign Application Priority Data

Feb. 13, 1992 [DE] Fed. Rep. of Germany ..... 4204177

[51] Int. Cl.[5] ..... B30B 3/04; D21G 1/02

[52] U.S. Cl. ..... 100/162 B; 100/153; 162/358.3; 492/7; 492/20

[58] Field of Search ..... 100/153, 155 R, 162 B, 100/170; 162/358.1, 358.3; 492/7, 20

[56] References Cited

U.S. PATENT DOCUMENTS

| | | | |
|---|---|---|---|
| 4,064,607 | 12/1977 | Wolf . | |
| 4,328,744 | 5/1982 | Pav et al. | 100/162 B |
| 4,498,383 | 2/1985 | Pav et al. | 100/162 B |
| 4,520,723 | 6/1985 | Pav et al. | 100/162 B |
| 4,570,314 | 2/1986 | Holik et al. | 100/162 B X |
| 4,639,346 | 1/1987 | Pav et al. | 492/7 X |
| 4,988,410 | 1/1991 | Meinecke et al. | 162/358.3 X |
| 5,081,759 | 1/1992 | Schiel | 100/162 B X |

FOREIGN PATENT DOCUMENTS

| | | | |
|---|---|---|---|
| 3733339 | 4/1989 | Fed. Rep. of Germany | 492/20 |
| 4123115 | 1/1993 | Fed. Rep. of Germany . | |

OTHER PUBLICATIONS

"A New Approach to Roll Crowning–Particularly for Calenders", *Paper Trade Journal*, pp. 36–42, Jul. 1960.

*Primary Examiner*—Stephen F. Gerrity

*Attorney, Agent, or Firm*—Marshall, O'Toole, Gerstein, Murray & Borun

[57] ABSTRACT

A press roll in cooperation with a mating roll defines a roll nip for the treatment of a moving web of material with the press roll and mating roll being oriented to provide a non-vertical pressing plane. The press roll includes a rotatable roll casing and a yoke located within the roll casing. The roll casing and the yoke defining an intermediate space therebetween. Certain press roll parameters such as the dimensions and material of the roll casing and the yoke and/or the degree of filling of the intermediate space with a liquid are selected such that gravity induced flexures of the roll casing and the yoke occurring in a median plane perpendicular to the pressing plane are approximately equal.

5 Claims, 1 Drawing Sheet

PRESS ROLL HAVING COMPONENTS EXHIBITING APPROXIMATELY EQUAL GRAVITY INDUCED FLEXURE

BACKGROUND OF THE INVENTION

1. Field of the Invention

The invention relates to a press roll which together with a mating roll defines a roll nip for the treatment of a moving web of material such as for dewatering of a web of paper in a paper machine.

2. Description of Related Technology

The press roll of the invention is based in part upon pressing apparatus which are known in the art, such as a compression roller for paper producing machinery disclosed in German patent publication 25 02 161 C, corresponding to Wolf, U.S. Pat. No. 4,064,607 (Dec. 27, 1977). These known apparatus typically include a press roll and a mating roll defining a roll nip. Such an apparatus may be oriented so that the median axes of the press roll and the mating roll lie in a non-vertical pressing plane and at least one of the two rolls is a "shoe roll."

A "shoe roll" may include a hollow, rotatable metallic roll casing disposed adjacent to the roll nip, a stationary yoke located within the roll casing and a shoe which transmits a pressing force from the yoke to the roll casing. Between the yoke and the shoe a pressure chamber may be provided in order to receive a pressure medium, such as hydraulic liquid for pressing the shoe against the roll casing. A lubricant film is also typically provided between the shoe and the roll casing in order to prevent metallic contact therebetween.

A consequence of providing a press roll with a hollow roll casing is that the roll casing flexes or bends under the action of the pressing force. The amount of bending preferably should be controlled so that variations in the pressing force along the width of a web of material being treated (i.e. along the length of the roll casing) is controlled as well. For example, if the press roll is mounted on a paper machine, the amount of bending of a roll casing should be controlled in order to provide a constant pressing force along the width of a web of paper being conveyed between the press roll and the mating roll.

In the compression roller disclosed in German patent publication 25 02 161 C and U.S. Pat. No. 4,064,607, it is assumed that the pressing plane (i.e. the plane containing the median axes of the press roll and the mating roll) is vertical. However, for the "shoe" type press roll according to the invention, a non-vertical pressing plane is assumed. For example, the pressing plane may be horizontal. When the pressing plane is not vertical, problems may arise because the pull of gravity on the press roll and the mating roll is not in the pressing plane and is rather at an angle thereto. Therefore, the lines of flexure resulting from the effect of gravity in the roll casing and the yoke may not be in agreement with each other. More particularly, the gravitational pull at the approximate center of the press roll in a median plane called the "shoe plane" (which is perpendicular to the pressing plane) may result in a maximum bend or flexure of the roll casing which is not equal to a maximum bend of flexure of the yoke. Because the shoe necessarily bends along its longitudinal axis in an amount approximately equal to the flexure or bend of the yoke, there may result a misfit between the outer surface of the shoe and the inner surface of the roll casing. As a result of this misfit there is a danger that the shoe may come into direct contact with some points on the inner surface of the roll casing which would cause an increase in frictional forces and wear.

SUMMARY OF THE INVENTION

An object of the present invention is to provide a press roll having a roll casing, a yoke and a shoe. The press roll cooperates with a mating roll with both rolls being oriented to provide a non-vertical pressing plane while at the same time the press roll is adapted to prevent a misfit between the outer surface of the shoe and the inner surface of the roll casing due to the force of gravity thereon.

The foregoing object is attained by a press roll adapted to cooperate with a mating roll to define a roll nip. The press roll and the mating roll are oriented so that their median axes lie in a non-vertical pressing plane. The press roll and/or the mating roll is a "shoe roll" having a hollow, rotatable roll casing disposed adjacent to the roll nip, a stationary yoke located within the roll casing and a shoe located between the yoke and the roll casing. The yoke and the roll casing define an intermediate space. A pressure chamber is located between the yoke and the shoe and is adapted to receive a pressure medium for pressing the shoe against the roll casing. Certain "shoe roll" parameters such as the dimensions and material of the roll casing and/or the dimensions and material of the yoke and/or the degree of filling of the intermediate space with a liquid are selected, such that gravity induced flexures of the roll casing and the yoke occurring in a median plane perpendicular to the pressing plane are approximately equal.

DETAILED DESCRIPTION OF THE INVENTION

Figure 1:
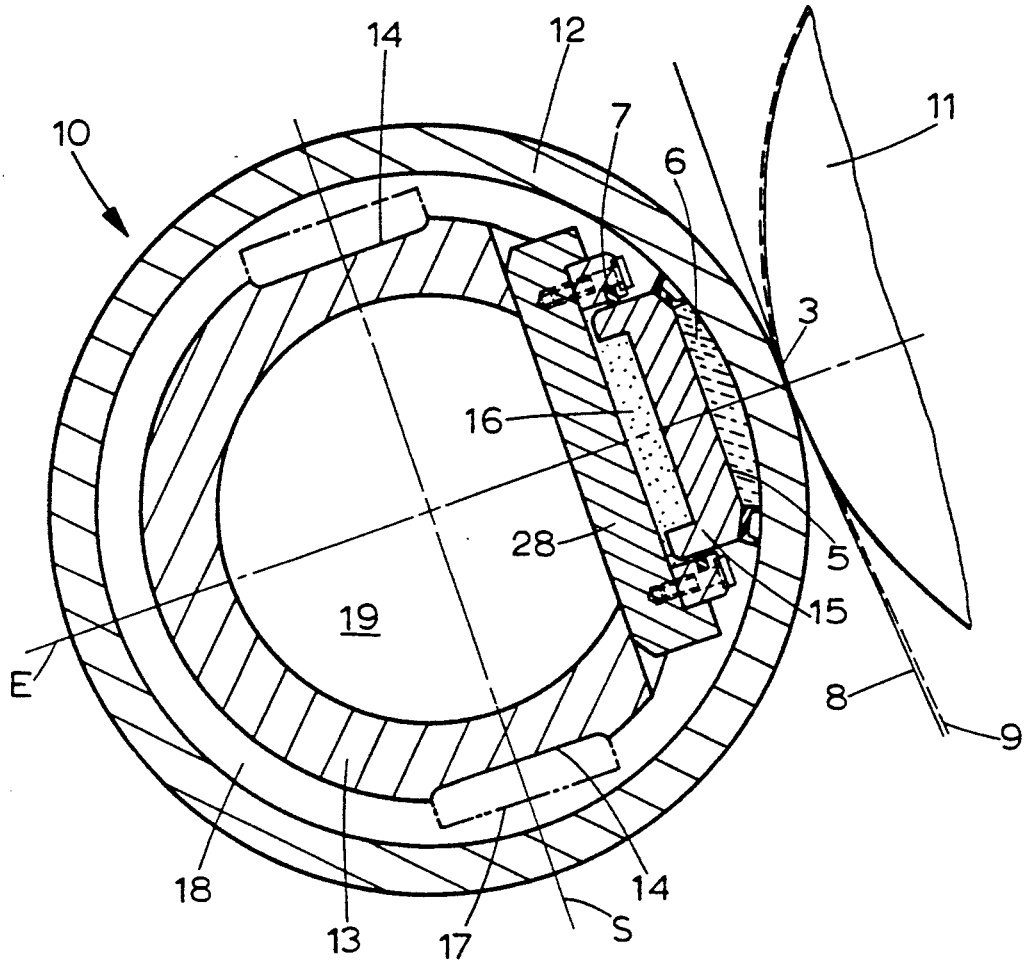
FIG. 1 shows a cross section of a press roll according to the invention.

The press roll according to the invention is a "shoe roll" having a hollow, rotatable roll casing being disposed adjacent to the roll nip, a stationary yoke located within the roll casing and a shoe located between the yoke and the roll casing and adapted to transmit a pressing force from the yoke to the roll casing. The yoke and the roll casing define an intermediate space. Between the yoke and the shoe, a pressure chamber is provided for receiving a pressure medium, such as hydraulic liquid, for pressing the shoe against the roll casing. Parameters of the press roll selected from the group consisting of (1) dimensions and material of the roll casing and the yoke and (2) the degree of filling of the intermediate space between the yoke and the roll casing with a liquid, are selected such that gravity induced flexures of the roll casing and the yoke occurring in a plane perpendicular to the pressing plane are approximately equal.

The roll casing dimensions, such as external and internal diameters and the material employed for the roll casing (more particularly the modulus of elasticity) are for the most part typically determined on the basis of the following factors: the desired pressing force of the press roll; the width of the machine upon which the press roll is mounted (equal to the length of the roll); and the desired speed of operation. Thus, there is little flexibility with regard to taking into account any other factors. Nevertheless, according to the invention, it is possible to select the dimensions for the yoke and the material thereof so that the lines of flexure of the roll casing and of the yoke (including the shoe) resulting from gravity are in substantially better agreement with each other than has so far been the case. In the special situation of a horizontally arranged pressing plane, the vertical flexures are simply made of equal size as far as possible. In the case of an oblique arrangement of the pressing plane it is also desired to select the parameters of the roll casing and yoke components of the press roll to have substantially equal flexure in the "shoe plane" (which is perpendicular to the pressing plane). In all such cases it is possible to ensure that despite a flexure of the roll casing and the yoke, which is transverse in relation to the pressing plane, there is a perfect fit between the shoe and the roll casing. There is thus no longer any danger of certain parts of the shoe coming into direct contact with the rotating roll casing. In other words, lubricant film which is normally employed to prevent metallic contact remains in existence over the entire outer surface of the shoe.

A press roll according to the invention can be produced in a relatively simple manner, such as by providing a yoke which is basically tubular, if the material of the roll casing has a lower modulus of elasticity than the material of the yoke. Thus, for example, gray cast iron can be utilized for the roll casing whereas steel can be utilized for the yoke.

With respect to the geometry of the yoke, the following features are to be taken into account but should not be deemed to be limiting. The yoke should preferably have a minimum mass so that the bending of the yoke under the effect of gravity is as small as possible, which may be achieved by a yoke which is in the form of a hollow body. The hollow body may be rectangular in nature, but a round hollow body is preferred.

In certain circumstances it may be preferable to fill the annular space between the roll casing and the yoke with a liquid. In such a case, the upthrust force acting on the hollow body should be taken into account. If the upthrust force creates variations in the respective flexures of the roll casing and the yoke, it is possible for the upthrust force to be eliminated by additionally filling all or part of the inner space of the yoke with liquid.

In order to further improve, if necessary, the fit between the roll casing and the shoe at least one additional weight may be added to the yoke, or for obtaining an opposite effect, a relief area or recess may be provided on the yoke, the weight or recess preferably being located adjacent to the median plane (i.e. "shoe plane") which is perpendicular to the pressing plane.

The shoe may be designed in the form of a hydrodynamically lubricated bearing element. (See U.S. Pat. No. 5,081,759 (Jan. 21, 1992), FIG. 6.) It is preferred however to provide a shoe having an outer surface with a hydrostatic relief pocket that faces the roll casing. (See German patent publication 25 02 161 C.) A preferred shoe having such a pocket is disclosed in German patent publication 41 23 115.

A press roll in which the distance between the bearings of the roll casing is the same as the distance between the bearings of the yoke is preferred. In such a press roll, the center points of the roll casing and the yoke located at both ends of the press roll are in the same plane normal to the press roll axis. Therefore, the desired perfect fit is obtained between the shoe and the roll casing since because in the said "shoe plane," the maximum bend in the middle of the tool casing is equal to the maximum bend in the middle of the yoke. However, even if the distances between the bearings are not equal, it is possible to obtain satisfactory results if bend lines of the roll casing and yoke components of the press roll in the "shoe plane" are matched to suit each other as much as possible.

The design of the invention is also applicable in a pressing device, which together with a mating roll defines an extended roll nip or gap. Such a pressing device differs from the inventive press roll described above insofar as instead of a metallic roll casing, an endless flexible (hose-like) press casing (closed at its ends) or a laterally open endless pressing belt is provided. An extended press roll nip is formed since the shoe has a concave sliding surface adapted to cooperate with the mating roll and over which the press casing or the pressing belt slides. In such an embodiment, there is the danger that under the pull of gravity there will be a misfit between the concave sliding surface of the shoe and the outer peripheral surface of the mating roll and that consequently the press casing or the pressing belt will be subjected to premature wear.

One embodiment of the invention will be described with reference to the drawings.

Figure 2:
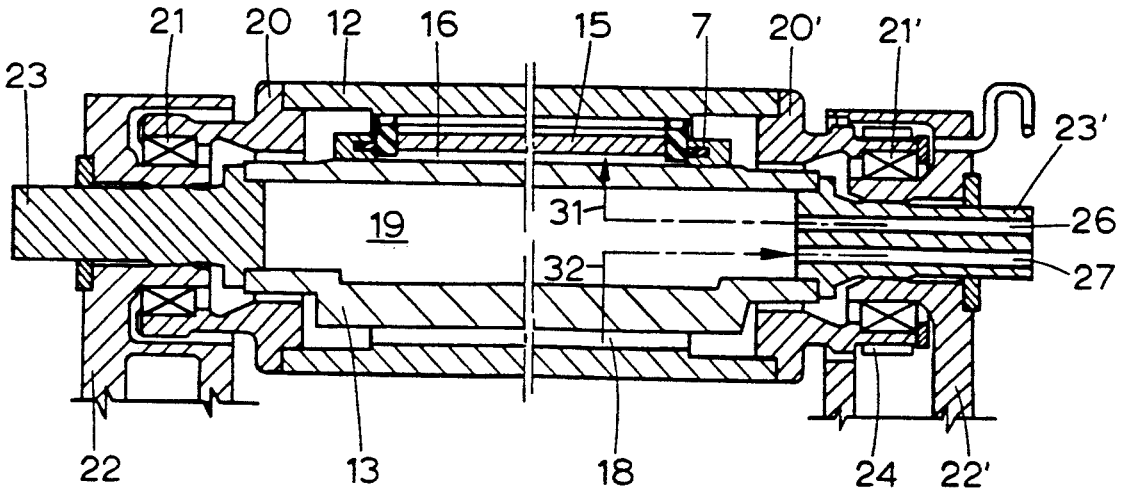
FIG. 2 shows a reduced longitudinal section of the press roll of FIG. 1 taken along plane E of FIG. 1.

With reference to FIGS. 1 and 2, a press roll of the invention generally designated 10 defines a pressing nip or gap 3 with a mating roll 11. It is through this gap that, for example, a paper web 9 is conveyed upwardly to be dewatered and a felt belt 8 is utilized to draw the water expressed from the web 9 in the gap 3. The press roll 10 includes a rotatable roll casing 12 adapted to be pressed against the mating roll 11 in a direction towards a pressing plane E. The pressing plane F, shown in the embodiment of FIG. 1 is slightly inclined to the horizontal. A stationary yoke 13 is located within the roll casing 12 and extends outwardly from either end thereof. The yoke 13 is in the form of a generally tube-like hollow body and is attached to a connecting plate 28. The hollow portion of the yoke 13 defines an inner space 19. The maximum amount of bend of the roll casing 12 and the yoke 13, resulting from gravity, occur in a median plane S (i.e. "shoe plane") perpendicular to the pressing plane E.

The press roll 10 also includes a shoe 15 located between the roll casing 12 and the yoke 13, and a hydrostatic pressure pocket 6 located at an outer side 5 of the shoe. A pressure chamber 16 is defined by the connecting plate 28, the shoe 15 and seals 7. The shoe 15 functions like a piston and may be moved radially in relation to the yoke 13 by action of hydraulic fluid pumped from a source (not shown) into the pressure chamber through a channel 26 and a conduit 31 and out of the chamber 16 through a conduit 32 and a channel 27. The seals 7 are adapted for permitting a tilting of the shoe 15 about an axis parallel to the axis of rotation of the press roll 10.

The roll casing 12 includes bearing necks or journals 20 and 20' at either end thereof, which run on anti-friction bearings 21 and 21' respectively in respective support holders 22 and 22'. The hollow bodied yoke 13 includes bearing necks or journals 23 and 23' located at either end thereof. The journals 23 and 23' are supported by means of a conical bushing 24 located in the one of the support holders 22 or 22'. The term "shoe" as used herein for identifying the shoe 15, which is a corelike part, has been selected, as a practical matter, because this part functions as a sliding shoe for the roll casing 12. The yoke 13 could be considered a support beam, as it extends like a beam along the longitudinal axis of the roll casing.

The wall thickness of the yoke 13 preferably is made as small as possible, contrary to known designs, in order to reduce bending thereof caused by gravity and thus to allow better adaptation to the bending of the roll casing 12 also resulting from gravity.

It is possible to calculate the dimensions, more particularly the wall thicknesses, of the yoke 13 and the roll casing 12 as a basic step toward achieving equal bending of the yoke 13 and the roll casing 12. In accordance with the invention, the material of the yoke 13 and the roll casing 12 are generally suitably adapted to each other, so that the roll casing 12 is manufactured of a material with a lower modulus of elasticity than the material utilized to make the yoke. For example, if the roll casing 12 is made from gray cast iron, it would be advantageous to make the yoke from steel. Variation between the materials of the roll casing and the yoke is not absolutely necessary, however, because an intermediate, generally annular space 18 defined by the yoke 13 and the roll casing 12 may be filled partially or totally with liquid. The upthrust produced by a liquid arranged in the space 18 causes an adaptation in the cooperation between the yoke and the roll casing if there is a suitable calculation of the dimensions (i.e. the wall thicknesses) of the yoke 13 and roll casing 12. In this respect, the intermediate space 18 can be completely filled with the liquid, which is preferably a hydraulic liquid also used for the pressure space or the space 18 may be only partly filled with liquid. Finally it is possible to have a combination of all of the measures described.

To provide a press roll according to the invention, the roll casing 12 and the yoke 13 may be adapted in ways other than by varying the wall thicknesses of the roll casing 12 and, respectively, the cylindrically tubular portion of the yoke 13 or of the connecting plate 28. Weights in the form of plates 17, shown in broken lines in FIG. 1, may be added to the yoke 13 and attached and fitted in corresponding grooves or lines of weakening 14 located along the median plane S. The weights 17 provide an increase in the weight of the yoke. If a decrease in the weight of the yoke is desired, the yoke 13 may be formed without extra plates 17. Recesses, such as shown by the grooves 14, can be provided on the yoke in order to further decrease the weight thereof. In the latter case however, there will also be a decrease in the moment of resistance of the yoke which may not be desirable. However, providing the yoke 13 with recesses or grooves 14 may be a simple and practical way of decreasing weight if the diameter of the cylindrical part of the yoke cannot be readily changed. It is necessary to take into account here the fact that the length of such a yoke may be more than 8 meters.

If a decision is made to fill the intermediate space 18 between the roll casing 12 and the yoke 13 with a liquid, it may also be desirable to completely or partly fill the interior space 19 of the yoke with a suitable liquid (if the intermediate space 18 is to be completely filled).

I claim:

1. In a press roll cooperating with a mating roll, the press roll and the mating roll defining a roll nip for treating a moving web of material and being oriented such that a median axis of the press roll and a median axis of the mating roll lie in a non-vertical pressing plane, said press roll comprising a hollow, rotatable roll casing being disposed adjacent to the roll nip;

a stationary yoke located within the roll casing, the yoke and the roll casing defining an intermediate space;

a shoe located between the yoke and the roll casing and being adapted to transmit a pressing force from the yoke to the roll casing; and a pressure chamber located between the yoke and the shoe and being adapted to receive a pressure medium for pressing the shoe against the roll casing; the improvement wherein at least one of the dimensions and material of the roll casing, the dimensions and material of the yoke, and the degree of filling of the intermediate space with a liquid are selected, such that gravity induced flexures of the roll casing and the yoke occurring in a median plane perpendicular to the pressing plane are approximately equal.

2. The improvement according to claim 1 wherein the yoke is tubular.

3. The improvement according to claim 1 wherein the yoke is hollow, having an inner surface defining an inner space being adapted for the placement of liquid therein.

4. The improvement according to claim 1 wherein the yoke additionally comprises at least one weight disposed in the median plane.

5. The improvement according to claim 1 wherein the yoke comprises at least one recess diminishing the weight of the yoke, the recess being disposed in the median plane.

* * * * *